US008220566B2

(12) United States Patent
Eason et al.

(10) Patent No.: US 8,220,566 B2
(45) Date of Patent: Jul. 17, 2012

(54) CARBURIZED MONOTUNGSTEN AND DITUNGSTEN CARBIDE EUTECTIC PARTICLES, MATERIALS AND EARTH-BORING TOOLS INCLUDING SUCH PARTICLES, AND METHODS OF FORMING SUCH PARTICLES, MATERIALS, AND TOOLS

(75) Inventors: Jimmy W. Eason, The Woodlands, TX (US); John H. Stevens, Spring, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 775 days.

(21) Appl. No.: 12/261,730

(22) Filed: Oct. 30, 2008

(65) Prior Publication Data

US 2010/0108399 A1 May 6, 2010

(51) Int. Cl.
*E21B 10/36* (2006.01)

(52) U.S. Cl. ..... 175/425

(58) Field of Classification Search ..... 175/425; 75/240

See application file for complete search history.

(56) References Cited

U.S. PATENT DOCUMENTS

| | | | | |
|---|---|---|---|---|
| 3,301,645 | A | 1/1967 | Smiley | |
| 4,743,515 | A | 5/1988 | Fischer et al. | |
| 4,884,477 | A | 12/1989 | Smith et al. | |
| 5,038,640 | A | 8/1991 | Sullivan et al. | |
| 5,090,491 | A | 2/1992 | Tibbitts et al. | |
| 5,567,662 | A | 10/1996 | Dunmead et al. | |
| 5,663,512 | A | 9/1997 | Schader et al. | |
| 6,248,149 | B1 | 6/2001 | Massey et al. | |
| 6,287,360 | B1 | 9/2001 | Kembaiyan et al. | |
| 6,354,362 | B1 | 3/2002 | Smith et al. | |
| 6,454,028 | B1 * | 9/2002 | Evans | 175/379 |
| 6,581,671 | B2 | 6/2003 | Butcher et al. | |
| 6,682,580 | B2 | 1/2004 | Findeisen et al. | |
| 7,303,030 | B2 | 12/2007 | Lockwood et al. | |
| 7,373,997 | B2 | 5/2008 | Kembaiyan et al. | |
| 7,625,542 | B2 * | 12/2009 | Zhang et al. | 423/440 |
| 2004/0060742 | A1 | 4/2004 | Kembaiyan et al. | |
| 2007/0079905 | A1 | 4/2007 | Gerk | |
| 2007/0102198 | A1 | 5/2007 | Oxford et al. | |
| 2007/0102199 | A1 | 5/2007 | Smith et al. | |
| 2007/0175669 | A1 | 8/2007 | Liang et al. | |
| 2008/0029310 | A1 | 2/2008 | Stevens et al. | |
| 2008/0073127 | A1 | 3/2008 | Zhan et al. | |
| 2008/0101977 | A1 | 5/2008 | Eason et al. | |

OTHER PUBLICATIONS

International Search Report for International Application No. PCT/US2009/061636 mailed Jun. 1, 2010, 3 pages.
International Written Opinion for International Application No. PCT/US2009/061636 mailed Jun. 1, 2010, 3 pages.

* cited by examiner

*Primary Examiner* — Cathleen Hutchins
(74) *Attorney, Agent, or Firm* — TraskBritt

(57) ABSTRACT

Earth-boring tools for drilling subterranean formations include a particle-matrix composite material comprising a plurality of at least partially carburized monotungsten carbide and ditungsten carbide eutectic particles dispersed throughout a matrix material. In some embodiments, the particles are at least substantially fully carburized monotungsten carbide and ditungsten carbide eutectic particles. In further embodiments, the particles are generally spherical or at least substantially spherical. Methods of forming such particles include exposing a plurality of monotungsten carbide and ditungsten carbide eutectic particles to a gas containing carbon. Methods of manufacturing such tools include providing a plurality of at least partially carburized monotungsten carbide and ditungsten carbide eutectic particles or at least substantially completely carburized monotungsten carbide and ditungsten carbide eutectic particles within a matrix material.

30 Claims, 6 Drawing Sheets

CARBURIZED MONOTUNGSTEN AND DITUNGSTEN CARBIDE EUTECTIC PARTICLES, MATERIALS AND EARTH-BORING TOOLS INCLUDING SUCH PARTICLES, AND METHODS OF FORMING SUCH PARTICLES, MATERIALS, AND TOOLS

TECHNICAL FIELD

Embodiments of the present invention generally relate to hard particles, materials including such hard particles, and to earth-boring tools including such hard particles or materials. Embodiments of the present invention also relate to methods of manufacturing such particles, materials, and earth-boring tools.

BACKGROUND OF THE INVENTION

Bodies of earth-boring tools, such as earth-boring rotary drill bits, may be formed from a particle-matrix composite material. Such particle-matrix composite materials include particles of hard material such as, for example, tungsten carbide dispersed throughout a metal matrix material (often referred to as a "binder" material). Particle-matrix composite materials exhibit relatively higher erosion and wear resistance relative to steel and other metal materials.

There are three primary types of tungsten carbide particles most often used in earth-boring tools, those being cast tungsten carbide particles, sintered tungsten carbide particles, and macrocrystalline tungsten carbide particles. The tungsten carbide system includes the two stoichiometric compounds of monotungsten carbide (WC) and ditungsten carbide ($W_2C$), as well as a continuous range of mixtures there between of these two compounds. Cast tungsten carbide particles generally include a eutectic mixture of the monotungsten carbide and ditungsten carbide stoichiometric compounds. Sintered tungsten carbide particles generally include relatively smaller particles of monotungsten carbide (WC) bonded together by a matrix material. Cobalt and cobalt alloys are often used as matrix materials in sintered tungsten carbide particles. Sintered tungsten carbide particles may be formed by mixing together a first powder that includes the tungsten carbide particles and a second powder that includes the relatively smaller cobalt particles. The powder mixture is formed in a "green" state. The green powder mixture then is sintered at a temperature near the melting temperature of the cobalt particles to form a matrix of cobalt material surrounding the tungsten carbide particles to form particles of sintered tungsten carbide. Finally, macrocrystalline tungsten carbide particles generally comprise single crystals of monotungsten carbide (WC).

Typically, the body of an earth-boring drill bit is formed by providing particulate tungsten carbide material in a mold cavity having a shape corresponding to the body of the drill bit to be formed, melting a metal matrix material, such as a copper-based alloy, and infiltrating the particulate tungsten carbide material with the molten metal matrix material. After infiltration, the molten metal matrix material is allowed to cool and solidify. The resulting bit body may then be removed from the mold. Cast tungsten carbide particles are often used for at least a portion of the particulate tungsten carbide material in such infiltration processes.

During such infiltration processes, the cast tungsten carbide particles may interact chemically with the surrounding metal matrix material at the elevated temperatures at which infiltration is carried out. For example, atomic diffusion may occur between the cast tungsten carbide particles and the metal matrix material during infiltration. As a result, carbon and tungsten may diffuse out from the cast tungsten carbide particles and into the metal matrix material during infiltration, resulting in the formation of relatively small deposits or regions of unintended metal carbide satellite materials (such as, for example, so-called "eta-phase" carbides or carbides having a composition of the form $M_6C$, where M is a metal) within the matrix material proximate the cast tungsten carbide particles. In these metal carbide satellite materials, the metal may be contributed by the matrix and the carbon may be contributed by the tungsten carbide particles. When a body of an earth-boring tool that includes such small metal carbide phases surrounding cast tungsten carbide particles cracks during use, the cracks may exhibit a tendency to propagate through the metal matrix material along a pathway that appears to follow the small metal carbide phases surrounding the cast tungsten carbide particles.

BRIEF SUMMARY OF THE INVENTION

In some embodiments, the present invention includes a powder of particles that may be used in forming a composite material for earth-boring tools. The composite material includes a first discontinuous phase within a continuous matrix phase. The first discontinuous phase includes the powder of the present invention. In some embodiments, the powder of the present invention may comprise partially carburized monotungsten carbide (WC) and ditungsten carbide ($W_2C$) eutectic particles wherein the particles have two layers: an inner core of monotungsten carbide (WC) and ditungsten carbide ($W_2C$) eutectic material and an outer shell of monotungsten carbide (WC). In another embodiment, the powder of the present invention may comprise fully carburized monotungsten carbide (WC) and ditungsten carbide ($W_2C$) eutectic particles, which comprise particles wherein the particles are at least substantially monotungsten carbide. The partially carburized particles and fully carburized particles may be generally spherical or at least substantially spherical.

Further embodiments include earth-boring tools, drill bits, and hardfacing materials comprising a particle-matrix composite material wherein the continuous matrix phase comprises of one or more metals or alloys and the hard particles comprise the partially carburized particles or fully carburized particles of the present invention. The partially carburized particles and fully carburized particles may be less reactive with the continuous matrix phase than monotungsten carbide and ditungsten carbide eutectic particles.

In further embodiments, the present invention includes methods of forming the particles of the current invention. The methods include carburizing a plurality of monotungsten carbide (WC) and ditungsten carbide ($W_2C$) eutectic particles. One example is to carburize the monotungsten carbide (WC) and ditungsten carbide ($W_2C$) eutectic particles by exposing the monotungsten carbide (WC) and ditungsten carbide ($W_2C$) eutectic particles to a gas containing carbon. In still further embodiments, the present invention includes methods of forming earth-boring tools, drill bits, and hardfacing materials. The methods include providing a plurality of partially carburized particles or fully carburized particles in a matrix material forming a particle-matrix material that can then be used in forming the earth-boring tools, drill bits, and hardfacing materials.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of embodiments of the invention when read in conjunction with the accompanying drawings, in which:

DETAILED DESCRIPTION OF THE INVENTION

Some of the illustrations presented herein are not meant to be actual views of any particular material, device, or system, but are merely idealized representations that are employed to describe the present invention. Additionally, elements common between figures may retain the same numerical designation.

Figure 1:
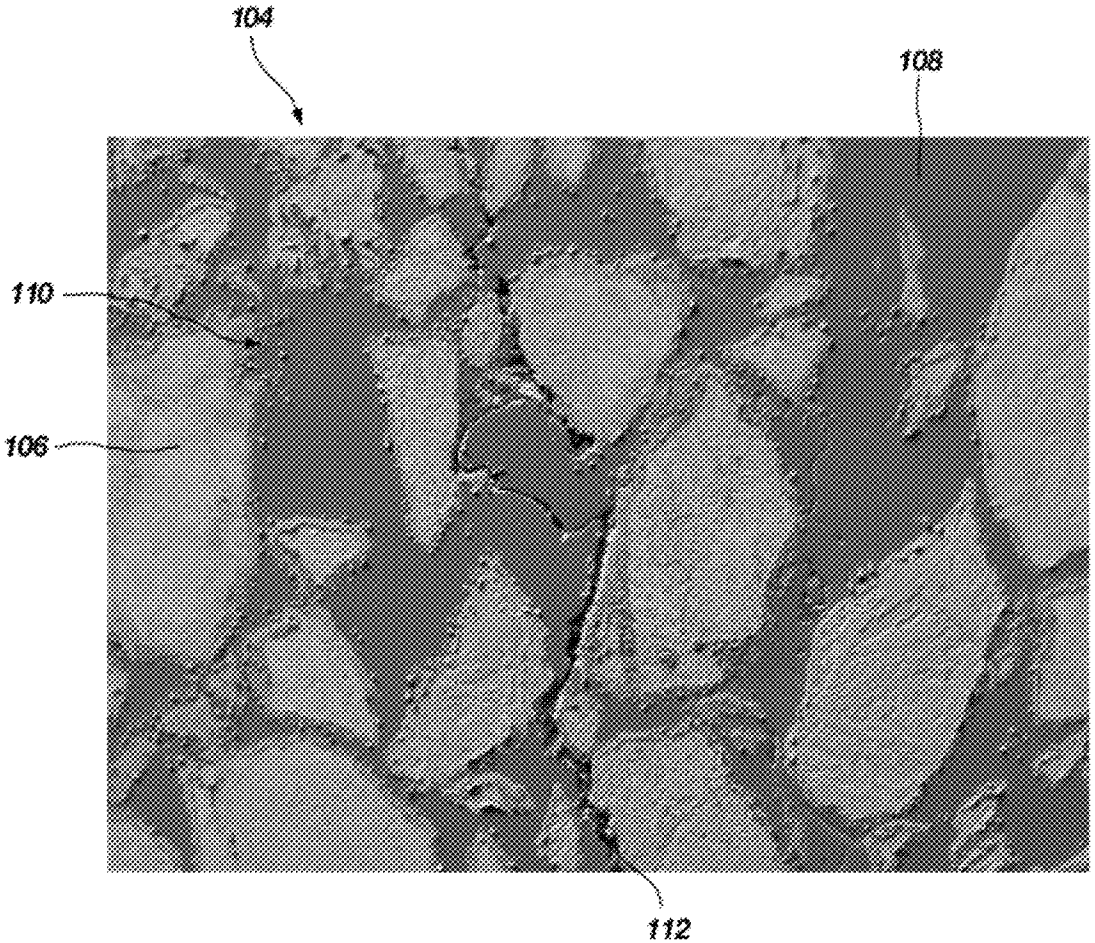
FIG. 1 is a photomicrograph of a portion of a drill bit illustrating a particle-matrix composite material that includes monotungsten carbide and ditungsten carbide eutectic particles embedded in a metal matrix material.

FIG. 1 is a photomicrograph of a particle-matrix composite material 104 of a bit body. The bit body is formed of the particle-matrix composite material 104, and the particle-matrix composite material 104 comprises a plurality of monotungsten carbide (WC) and ditungsten carbide ($W_2C$) eutectic particles 106 (which are the relatively lighter gray particles shown in the photomicrograph of FIG. 1), dispersed throughout a metal (e.g., a commercially pure metal or a metal alloy) matrix material 108 (which is the relatively darker gray material surrounding the lighter gray particles). In other words, the particle-matrix composite material 104 includes a plurality of discontinuous hard phase regions, each of which comprises a monotungsten carbide and ditungsten carbide eutectic composition, and the hard phase regions are dispersed throughout a continuous metal phase. In the photomicrograph of FIG. 1, the monotungsten carbide (WC) and ditungsten carbide ($W_2C$) eutectic particles 106 are the relatively lighter gray particles, and the matrix material 108 is the relatively darker gray material surrounding the lighter gray eutectic particles 106.

As shown in FIG. 1, the monotungsten carbide (WC) and ditungsten carbide ($W_2C$) eutectic particles 106 are surrounded by relatively smaller satellite deposits 110 that comprise metal carbide materials. These metal carbide satellite deposits 110 may form as a result of chemical interactions between the monotungsten carbide (WC) and ditungsten carbide ($W_2C$) eutectic particles 106 and the surrounding matrix material 108. As shown in FIG. 1, a crack 112 has formed in the matrix material 108, which extends along a path that follows (at least in several sections) the locations of the metal carbide satellite deposits 110. As a result, it is currently believed that reducing or eliminating such metal carbide satellite deposits 110 in particle-matrix composite materials of earth-boring tools may improve the fracture toughness of such tools.

Metal carbide satellite deposits 110 are a product of chemical reactions between the monotungsten carbide (WC) and ditungsten carbide ($W_2C$) eutectic particles 106 and the surrounding matrix material 108. In the monotungsten carbide (WC) and ditungsten carbide ($W_2C$) eutectic particles 108, while the $W_2C$ phase is harder then the WC phase, the WC phase is chemically more stable then the $W_2C$ phase. Therefore, relatively more of the metal carbide satellite deposits 110 may be formed from reactions between the $W_2C$ phase and the metal matrix material 108 than from reactions between the WC phase and the metal matrix material 108.

Figure 2:
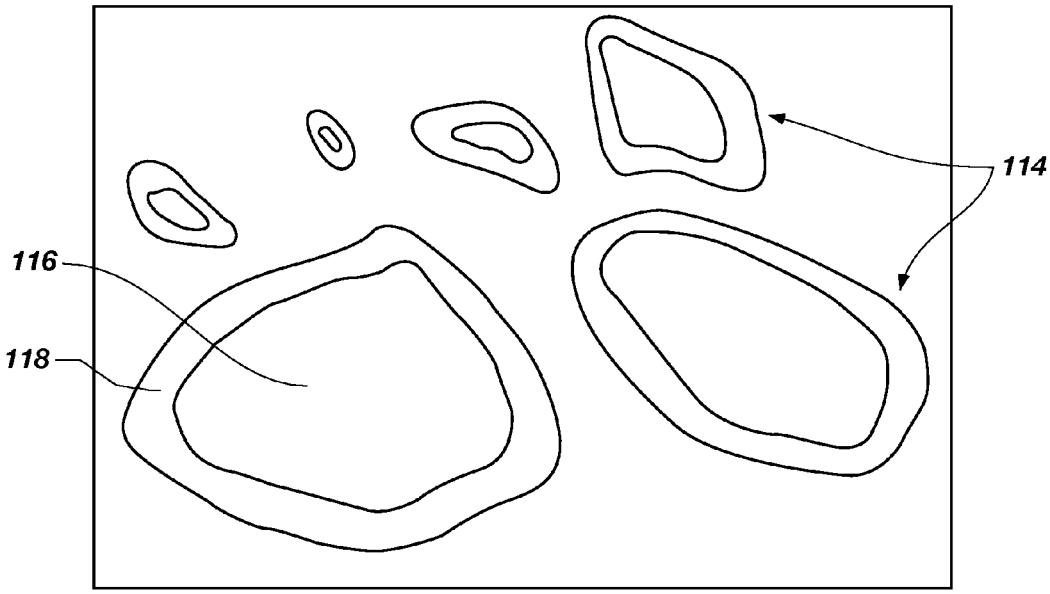
FIG. 2 is a simplified illustration showing one example of how a microstructure of an embodiment of a particle-matrix composite material of the present invention, which includes partially carburized tungsten carbide eutectic particles, may appear under magnification.

FIG. 2 is a simplified illustration showing one example of how a microstructure of an embodiment of a particle-matrix composite material of the present invention may appear under magnification. The particle-matrix composite material shown in FIG. 2 includes partially carburized monotungsten carbide (WC) and ditungsten carbide ($W_2C$) eutectic particles 114 (hereinafter "partially carburized particles 114"). The partially carburized particles 114 comprise an inner core 116 having a eutectic composition of monotungsten carbide (WC) and ditungsten carbide ($W_2C$). The inner core 116 is surrounded by an outer shell 118 that is at least substantially comprised by monotungsten carbide (WC). The outer shell 118 of monotungsten carbide (WC) may be formed prior to infiltration. By providing the outer shell 118 of monotungsten carbide (WC) around the inner core 116, the ditungsten carbide ($W_2C$) phase regions in the inner core 116 will not be exposed during infiltration, and, therefore, the partially carburized particles 114 may be less susceptible to the chemical reactions that result in the formation of the metal carbide satellite deposits 110 during infiltration of the matrix material 108.

Figure 3:
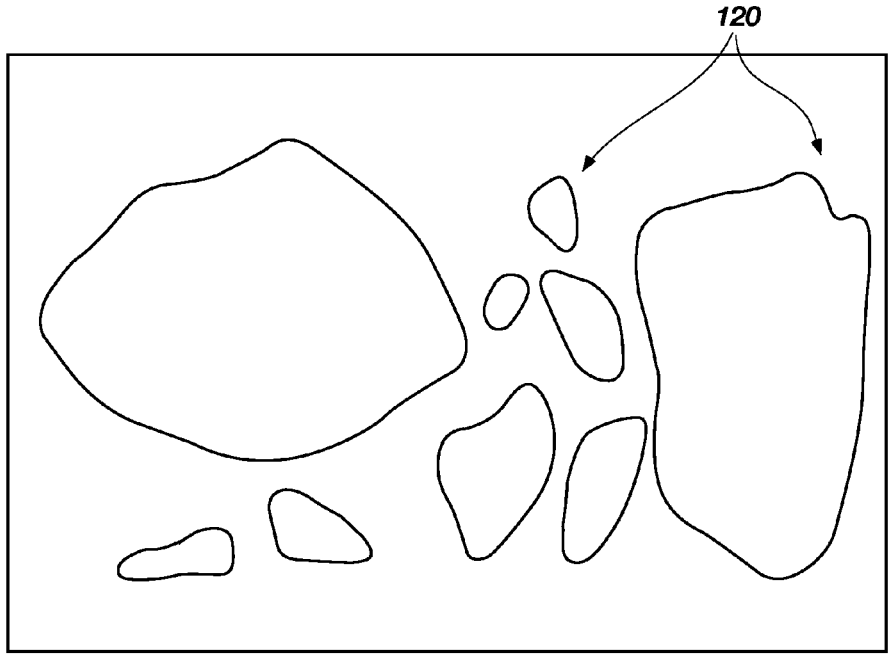
FIG. 3 is a simplified illustration showing one example of how a microstructure of another embodiment of a particle-matrix composite material of the present invention, which includes at least substantially fully carburized tungsten carbide eutectic particles, may appear under magnification.

FIG. 3 is a simplified illustration showing one example of how a microstructure of another embodiment of a particle-matrix composite material of the present invention may appear under magnification. The particle-matrix composite material shown in FIG. 3 includes at least substantially completely carburized monotungsten carbide (WC) and ditungsten carbide ($W_2C$) eutectic particles 120 (hereinafter "fully carburized particles 120"). In the fully carburized particles 120, the ditungsten carbide ($W_2C$) phase of the monotungsten carbide (WC) and ditungsten carbide ($W_2C$) eutectic particle is completely or at least substantially eliminated. The ditungsten carbide ($W_2C$) phase may be completely or at least substantially converted to a monotungsten carbide (WC) phase, although the ditungsten carbide ($W_2C$) phase may remain in limited amounts in an inner core 116 (e.g., less than about 5% by volume of the fully carburized particles 120).

In some embodiments of the present invention, powders may be formed using partially carburized particles 114, fully carburized particles 120, or both partially carburized particles 114 and fully carburized particles 120, and such powders may be used in forming bodies and components of earth-boring tools. Such powders may also comprise other tungsten carbide particles such as uncarburized monotungsten carbide (WC) and ditungsten carbide ($W_2C$) eutectic particles, macrocrystalline tungsten carbide, sintered tungsten carbide, as well as other hard particles such as diamond particles, silicon carbide particles, silicon nitride particles, boron nitride particles, etc.

In some embodiments of the present invention, powders may be formed using partially carburized particles 114 and/or fully carburized particles 120 having different average particle sizes. For example, a powder comprising partially carburized particles 114 and/or fully carburized particles 120 may have a multi-modal average particle size distribution (e.g., bi-modal, tri-modal, tetra-modal, penta-modal, etc.). In other embodiments, however, the partially carburized particles 114 and/or fully carburized particles 120 may have a single and substantially uniform average particle size, and the particles may exhibit a Gaussian or log-normal average particle size distribution. By way of example and not limitation, the partially carburized particles 114 and/or fully carburized particles 120 in a powder or powder mixture may include a plurality of particles having an average particle diameter of less than about 500 microns. In some embodiments, the partially carburized particles 114 and/or fully carburized particles 120 in a powder or powder mixture may include a plurality of particles having an average particle diameter of between about 44 microns and about 250 microns. In other embodiments, the partially carburized particles 114 and/or fully carburized particles 120 in a powder or powder mixture may include a plurality of particles having an average particle diameter of between about 105 microns and about 250 microns. Using conventional ASTM measurements, the partially carburized particles 114 and/or fully carburized particles 120 may comprise −60/+140 ASTM (American Society for Testing and Materials) mesh size particles. As used herein, the phrase "−60/+140 ASTM mesh size particles" means particles that pass through an ASTM No. 60 U.S.A. standard testing sieve, but not through an ASTM No. 140 U.S.A. standard testing sieve as defined in ASTM Specification E11-04, which is entitled *Standard Specification for Wire Cloth and Sieves for Testing Purposes*.

In some embodiments, partially carburized particles 114 and/or fully carburized particles 120 of the present invention may comprise generally rough, non-rounded (e.g., polyhedron-shaped) particles. In other embodiments, partially carburized particles 114 and/or fully carburized particles 120 of the present invention may comprise generally smooth, rounded particles. Particle-matrix composite materials that include generally smooth, round particles may exhibit higher fracture toughness relative to particle-matrix composite materials that include rough, non-rounded particles, as relatively sharper points and edges on particles may promote the formation of cracks in the resulting particle-matrix composite material. In some embodiments, partially carburized particles 114 and fully carburized particles 120 as described hereinabove may have a generally spherical shape having an average sphericity (Ψ) of 0.6 or higher. Sphericity (Ψ) is defined by the equation:

$$\Psi = \frac{\pi^{\frac{1}{3}}(6V_p)^{\frac{2}{3}}}{A_p}$$

wherein $V_p$ is the volume of the particle and $A_p$ is the surface area of the particle. In additional embodiments, partially carburized particles 114 and fully carburized particles 120 as described hereinabove may have an at least substantially spherical shape and may have an average sphericity (Ψ) of 0.9 or greater.

According to embodiments of the present invention, fully carburized particles 120 may be generally or at least substantially spherical in shape. The resulting particles may be at least substantially comprised by monotungsten carbide (WC), and may not include the relatively sharp points and edges that are typically present on monotungsten carbide (WC) macrocrystalline particles. The fully carburized particles 120, which may be at least substantially comprised by monotungsten carbide (WC), also may be larger than monotungsten carbide (WC) macrocrystalline particles currently known in the art.

As previously mentioned, partially carburized particles 114 and/or fully carburized particles 120, as described hereinabove, may be dispersed throughout a matrix material 108 to form a particle-matrix composite material 104. In some embodiments, the matrix material 108 may comprise a commercially pure metal such as copper, cobalt, iron, nickel, aluminum, or titanium. In additional embodiments, the metal matrix material 108 may comprise a metal alloy material such as a copper-based alloy, a cobalt-based alloy, an iron-based alloy, a nickel-based alloy, a cobalt- and nickel-based alloy, an iron- and nickel-based alloy, an iron- and cobalt-based alloy, an aluminum-based alloy, a magnesium-based alloy, or a titanium-based alloy. In some embodiments of the invention, the particle matrix composite material 104 may be at least substantially free of metal carbide satellite deposits 110.

The partially carburized particles 114 and/or fully carburized particles 120 may be formed by at least partially carburizing monotungsten carbide (WC) and ditungsten carbide ($W_2C$) eutectic particles. The monotungsten carbide (WC) and ditungsten carbide ($W_2C$) eutectic particles may be formed by melting a eutectic mixture of carbon and tungsten (e.g., between about fifty-nine atomic percent (59 at %) and about sixty-three atomic percent (63 at %) carbon, and between about forty-one atomic percent (41 at %) and about thirty-seven atomic percent (37 at %) tungsten). The mixture may be melted by heating the mixture to a temperature above about 2735° C. As the mixture cools from just below a temperature of 2735° C. to room temperature, the monotungsten carbide (WC) phases and ditungsten carbide ($W_2C$) phases will at least substantially simultaneously solidify. The mixture may be allowed to cool in a crucible or the mixture may be cooled quickly by splat cooling, wherein the melted mixture is poured onto a cool surface. The resulting material will comprise a microstructure of alternating regions of monotungsten carbide (WC) phases and ditungsten carbide ($W_2C$) phases. The solidified material may then be crushed to form monotungsten carbide (WC) and ditungsten carbide ($W_2C$) eutectic particles. In additional embodiments, an atomizer may be used to form the monotungsten carbide (WC) and ditungsten carbide ($W_2C$) eutectic particles. For example, the molten carbon and tungsten eutectic mixture may be sprayed out from a nozzle into a cold gas, such as, for example, helium or argon within a container to form small particles of the monotungsten carbide and ditungsten carbide eutectic composition.

The monotungsten carbide (WC) and ditungsten carbide ($W_2C$) eutectic particles may be carburized by, for example, exposing the eutectic particles to a gas containing carbon such as, for example, an alkane (e.g., methane, ethane, propane, etc.) at an elevated temperature (e.g., within the range extending from about 2,000° C. to about 2,600° C.). The carburizing process may be performed in a fluidized bed or a powder bed.

The ditungsten carbide ($W_2C$) phase near the surface of the particle may react with the carbon gas such that carbon atoms from the gas are used to convert the ditungsten carbide ($W_2C$) phase to a monotungsten carbide (WC) phase in an outer shell 118 of the particles. The thickness of the outer shell 118 may be controlled by either limiting the time the monotungsten carbide (WC) and ditungsten carbide ($W_2C$) eutectic particles are exposed to the gas containing carbon, or by limiting the amount of carbon to which the monotungsten carbide (WC) and ditungsten carbide ($W_2C$) eutectic particles are exposed. It is noted, however, that in some embodiments, the carburization process may be a self-limiting or rate-limiting process in which, after carrying out the carburization reaction for a period of time, the rate at which the ditungsten carbide ($W_2C$) phase in the eutectic particles is being converted to a monotungsten carbide (WC) phase is essentially zero. In other words, the outer shell 118 may be grown or otherwise formed in the particles from the exterior surfaces thereof in an inward direction. After a certain period of time, the rate at which the thickness of the outer shell 118 is increasing (and, hence, the average diameter of the inner core 116 is decreasing) may decrease to essentially zero, at which time no significant further conversion of the ditungsten carbide ($W_2C$) phase to a monotungsten carbide (WC) phase will be performed by continuing the carburization process.

Figure 4:
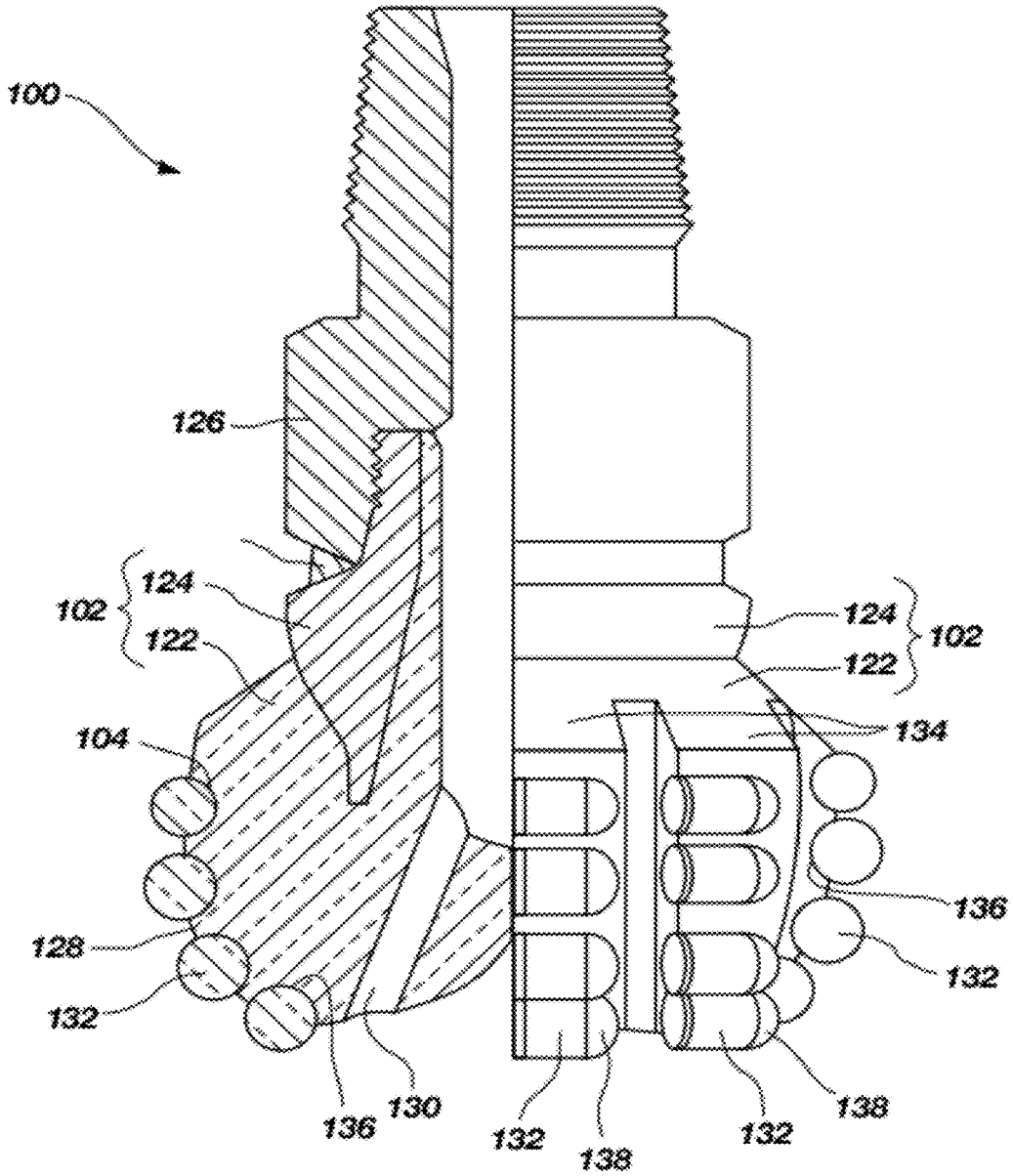
FIG. 4 is a partial cross-sectional side view of an embodiment of an earth-boring rotary drill bit of the present invention that includes a bit body comprising an embodiment of a particle-matrix composite material of the present invention.

As previously mentioned, embodiments of partially carburized particles 114 and/or fully carburized particles 120 of the present invention may be used to form a body or component of any earth-boring tool. By way of example and not limitation, an earth-boring rotary drill bit may include a body comprising partially carburized particles 114 and/or fully carburized particles 120 as previously described herein. A non-limiting embodiment of an earth-boring rotary drill bit 100 of the present invention is shown in FIG. 4. The drill bit 100 includes a bit body 102 comprising a particle-matrix composite material that may include a plurality of partially carburized particles 114, a plurality of fully carburized particles 120, or a mixture of partially carburized particles 114 and fully carburized particles 120 dispersed throughout a metal matrix material 108 (FIG. 1). By way of example and not limitation, the bit body 100 may include a crown region 122 and a metal blank 124. In other embodiments, however, the bit body 100 may not include a metal blank 124, or the bit body 100 may include a so-called "extension" or "cross-over" (which may be attached to the crown region 122 after formation of the crown region 122 as opposed to during formation of the crown region 122) instead of a metal blank 124. The crown region 122 may be at least predominantly comprised of a particle-matrix composite material. The metal blank 124 may comprise a machinable metal or metal alloy such as, for example, a steel alloy, and may be configured for securing the crown region 122 of the bit body 102 to a metal shank 126, which may be secured to a drill string (not shown).

In some embodiments, nozzle inserts (not shown) may be provided at the face 128 of the bit body 102 within the internal fluid passageways 130. The drill bit 100 may include a plurality of cutting structures on the face 128 thereof. By way of example and not limitation, a plurality of polycrystalline diamond compact (PDC) cutters 132 may provided on each of the blades 134, as shown in FIG. 4. The PDC cutters 132 may be provided along the blades 134 within cutting element pockets 136 formed on the face 128 of the bit body 102, and may be supported from behind by buttresses 138, which may be integrally formed with the crown region 122 of the bit body 102.

Figure 5:
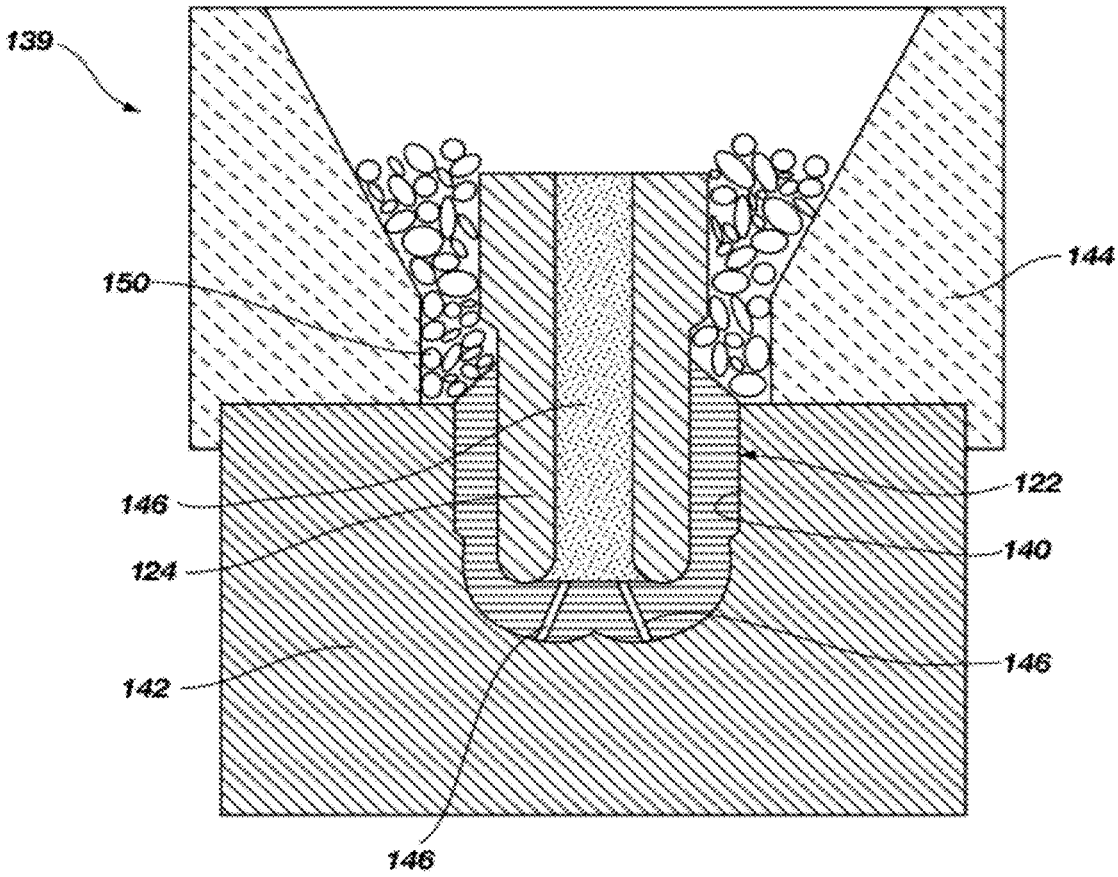
FIG. 5 illustrates a method of forming the earth-boring rotary drill bit shown in FIG. 4.

In some embodiments, the bit body 102 may be formed using so-called "infiltration" casting techniques. FIG. 5 shows a simplified configuration that may be used in the infiltration casting technique. For example, a mold assembly 139 may be provided that includes a mold cavity 140 having a size and shape corresponding to the size and shape of the bit body 102. The mold assembly comprises a bottom portion 142 and an upper portion 144. The bottom portion of the mold assembly houses the mold cavity 140. The mold assembly 139 may be formed from, for example, graphite or any other high-temperature refractory material, such as a ceramic. The mold cavity 140 of the mold assembly 139 may be machined using a multi-axis (e.g., 5, 6, or 7-axis) machine tool. Fine features may be added to the cavity 140 of the mold assembly 139 using hand-held tools. Additional clay work also may be required to obtain the desired configuration of some features of the bit body 102. Where necessary, preform elements or displacements 146 (which may comprise ceramic components, graphite components, or resin-coated sand compact components) may be positioned within the mold cavity and used to define the internal fluid passageways 130, cutting element pockets 136, and other external topographic features of the bit body 102 (FIG. 4).

After forming the mold assembly 139, a powder comprising a plurality of partially carburized particles 114 (FIG. 2) and/or fully carburized particles 120 (FIG. 3), as previously described herein, may be provided within the mold cavity 140 to form a powder bed 148 having a shape that corresponds to at least the crown region 122 of the bit body 102. Optionally, a metal blank 124 may be at least partially embedded within the powder bed 148 comprising the partially carburized particles 114 and/or fully carburized particles 120 such that at least one surface of the metal blank 124 is exposed to allow subsequent machining of the surface of the metal blank 124 (if necessary) and subsequent attachment thereof to the shank 126 (FIG. 4).

After forming the powder bed 148, particles 150 of matrix material 108 (FIG. 1) are placed within the upper portion 144 of the mold assembly 139 over the powder bed 148. The upper portion 144 of the mold assembly 139 may act as a funnel for particles 150. The entire mold assembly 139 may then be placed within a furnace and heated to a temperature at least at the melting point of particles 150.

As the particles 150 melt, molten matrix material 108 may be allowed or caused to infiltrate the spaces between the partially carburized particles 114 (FIG. 2) and/or fully carburized particles 120 (FIG. 3) within the mold cavity 140. As the molten materials may be susceptible to oxidation, the infiltration process may be carried out under vacuum or in an inert atmosphere. In some embodiments, pressure may be applied to the molten matrix material 108 and the partially carburized particles 114 and/or fully carburized particles 120 to facilitate the infiltration process and to substantially prevent the formation of voids within the bit body 102 being formed.

After the powder bed 142 comprising the partially carburized particles 114 and/or fully carburized particles 120 has been infiltrated with the molten matrix material 108 within the mold assembly 139, the molten matrix material 108 may be allowed to cool and solidify around the partially carburized particles 114 and/or fully carburized particles 120, thereby forming the solid matrix material 108 of the particle-matrix composite material 104.

In additional embodiments, the bit body 102 may be formed using so-called particle compaction and sintering techniques such as, for example, those disclosed in pending U.S. patent application Ser. No. 11/271,153, filed Nov. 10, 2005, entitled Earth-Boring Rotary Drill Bits and Methods of Forming Earth-Boring Rotary Drill Bits, and pending U.S. patent application Ser. No. 11/272,439, filed Nov. 10, 2005, entitled Earth-Boring Rotary Drill Bits and Methods of Manufacturing Earth-Boring Rotary Drill Bits Having Particle-Matrix Composite Bit Bodies the entire disclose of each of which application is incorporated herein by this reference. An example of a manner in which the bit body 102 may be formed using powder compaction and sintering techniques is described briefly below.

Figure 6A:
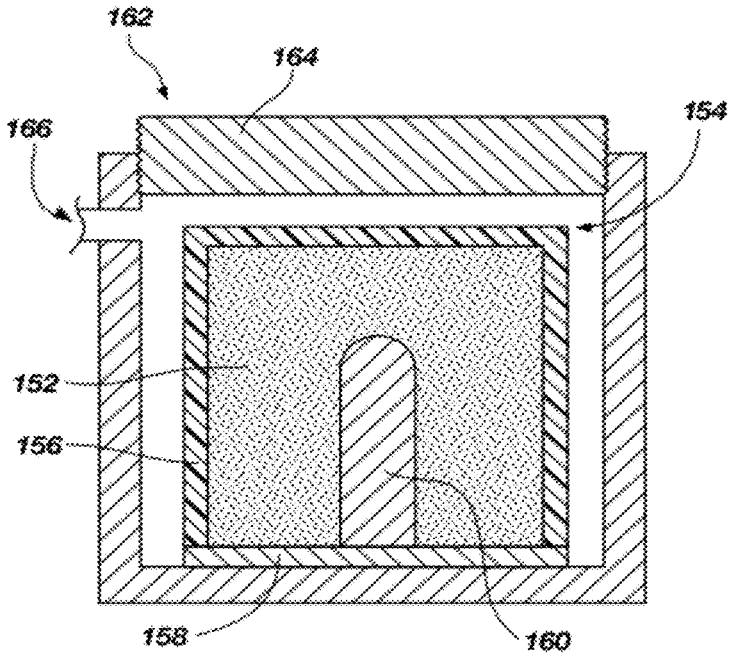
FIGS. 6A-6E illustrate an additional method of forming the earth-boring rotary drill bit shown in FIG. 4.

Referring to FIG. 6A, a powder mixture 152 may be pressed (e.g., with substantially isostatic pressure) within a mold or container 154. The powder mixture 152 may include the partially carburized particles 114 (FIG. 2) and/or fully carburized particles 120 (FIG. 3) of the present invention and a plurality of particles comprising a matrix material 108. Optionally, the powder mixture 152 may further include additives commonly used when pressing powder mixtures such as, for example, organic binders for providing structural strength to the pressed powder component, plasticizers for making the organic binder more pliable, and lubricants or compaction aids for reducing inter-particle friction and otherwise providing lubrication during pressing.

The container 154 may include a fluid-tight deformable member 156 such as, for example, deformable polymeric bag and a substantially rigid sealing plate 158. Inserts or displacement members 160 may be provided within the container 154 for defining features of the bit body 102 such as, for example, the internal fluid passageways 130 (FIG. 1) of the bit body 102. The sealing plate 158 may be attached or bonded to the deformable member 156 in such a manner as to provide a fluid-tight seal there between.

The container 154 (with the powder mixture 152 and any desired displacement members 160 contained therein) may be pressurized within a pressure chamber 162. A removable cover 164 may be used to provide access to the interior of the pressure chamber 162. A fluid (which may be substantially incompressible) such as, for example, water, oil, or gas (such as, for example, air or nitrogen) is pumped into the pressure chamber 162 through an opening 166 at high pressures using a pump (not shown). The high pressure of the fluid causes the walls of the deform able member 156 to deform, and the fluid pressure may be transmitted substantially uniformly to the powder mixture 152.

Figure 6B:
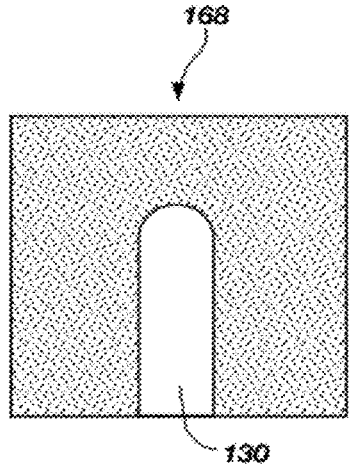

Pressing of the powder mixture 152 may form a green (or unsintered) body 168 shown in FIG. 6B, which can be removed from the pressure chamber 162 and container 154 after pressing.

The green body 168 shown in FIG. 6B may include a plurality of particles (partially carburized particles 114 (FIG. 2) and/or fully carburized particles 120 (FIG. 3) and particles of matrix material) held together by interparticle friction forces and an organic binder material provided in the powder mixture 152 (FIG. 6A). Certain structural features may be machined in the green body 168 using conventional machining techniques including, for example, turning techniques, milling techniques, and drilling techniques. Hand held tools also may be used to manually form or shape features in or on the green body 168. By way of example and not limitation, blades 134 (FIG. 4), and other features may be machined or otherwise formed in the green body 168 to form a partially shaped green body 170 shown in FIG. 6C.

Figure 6C:
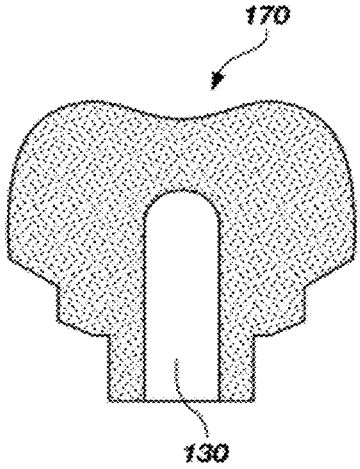
Figure 6D:
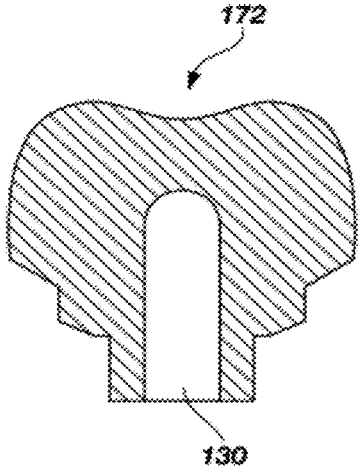

The partially shaped green body 170 shown in FIG. 6C may be at least partially sintered to provide a brown (partially sintered) body 172 shown in FIG. 2D, which has less than a desired final density. Partially sintering the green body 170 to form the brown body 172 may cause at least some of the plurality of particles to have at least partially grown together to provide at least partial bonding between adjacent particles. The brown body 172 may be machinable due to the remaining porosity therein. Certain structural features also may be machined in the brown body 172 using conventional machining techniques.

Figure 6E:
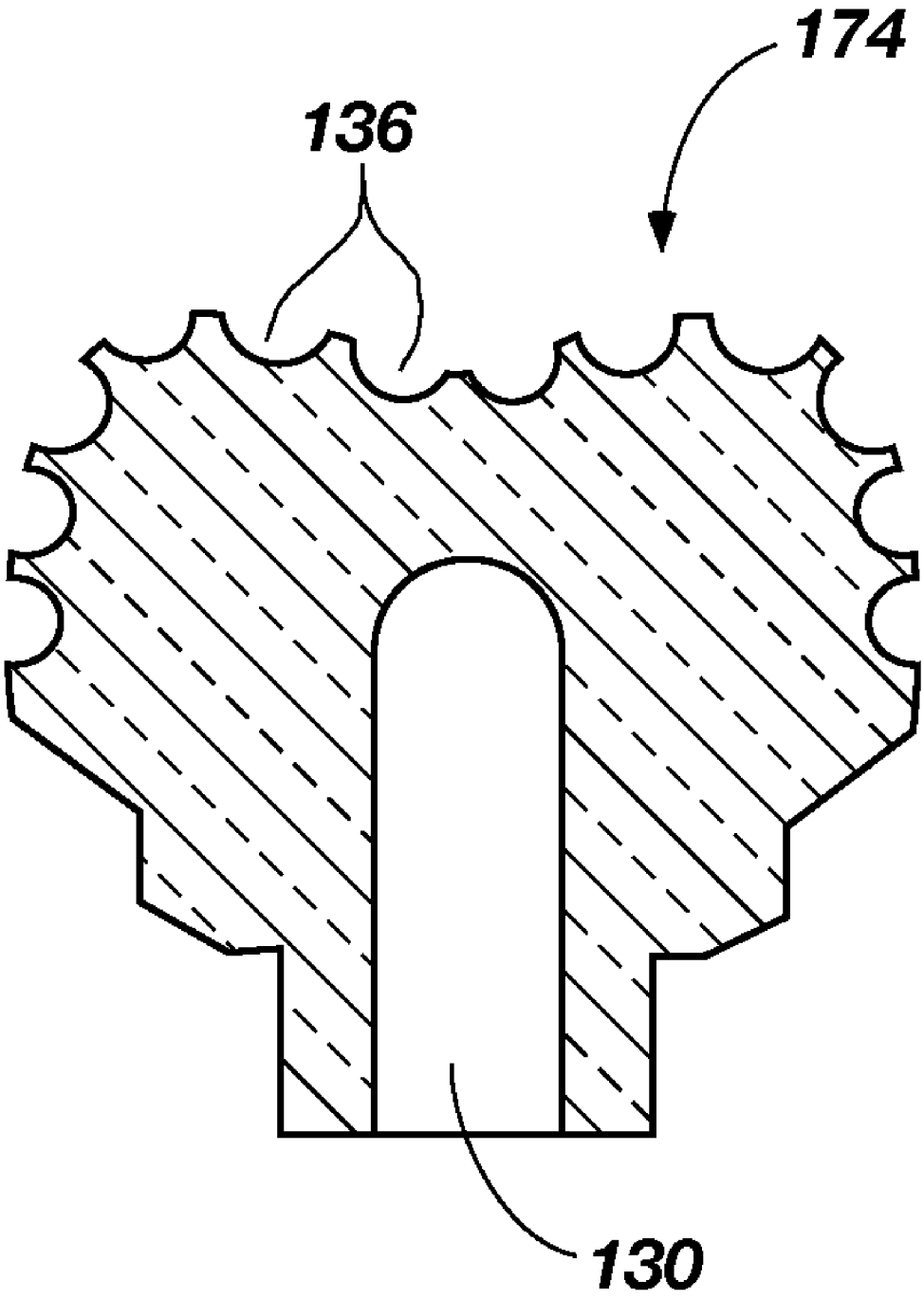

By way of example and not limitation, internal fluid passageways 130, cutting element pockets 136, and buttresses 138 (FIG. 4) may be machined or otherwise formed in the brown body 172 to form a brown body 174 shown in FIG. 6E. The brown body 174 shown in FIG. 6E then may be fully sintered to a desired final density, and the PDC cutters 132 may be secured within the cutting element pockets 136 to provide the bit body 102 shown in FIG. 4.

In other methods, the green body 168 shown in FIG. 6B may be partially sintered to form a brown body without prior machining, and all necessary machining may be performed on the brown body prior to fully sintering the brown body to a desired final density. Alternatively, all necessary machining may be performed on the green body 168 shown in FIG. 6B, which then may be fully sintered to a desired final density.

The sintering process may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes may include sub-liquidus phase sintering. In other words, the sintering processes may be conducted at temperatures proximate to but below the liquidus line of the phase diagram for the matrix material. For example, the sintering processes may be conducted using a number of different methods known to one of ordinary skill in the art, such as the Rapid Omnidirectional Compaction (ROC) process, the -CERACON® process, hot isostatic pressing (HIP), or adaptations of such processes.

When the bit body 102 is formed by particle compaction and sintering techniques, the bit body 102 may not include a metal blank 124 and may be secured to the metal shank 126 by, for example, one or more of brazing or welding. Furthermore, in such embodiments, an extension comprising a machinable metal or metal alloy (e.g., a steel alloy) may be secured to the bit body 102 and used to secure the bit body 102 to a shank 126.

Additional embodiments of the present invention comprise components of earth-boring tools that include a plurality of partially carburized particles 114 (FIG. 2) and/or fully carburized particles 120 (FIG. 3), as previously described herein. For example, substrates for PDC cutters 132 may comprise a particle-matrix composite material that includes a plurality of partially carburized particles 114 (FIG. 2) and/or fully carburized particles 120 (FIG. 3), as previously described herein. For example, such PDC cutter 132 substrates may comprise a particle-matrix composite material including a plurality of partially carburized particles 114 and/or fully carburized particles 120 embedded within a cobalt or cobalt-based alloy matrix material 108. Diamond tables may be formed on such substrates to form the PDC cutters 132, as known in the art. As another example, nozzles or nozzle inserts for earth-boring tools, such as earth-boring rotary drill bits, may comprise a particle-matrix composite material that includes a plurality of partially carburized particles 114 (FIG. 2) and/or fully carburized particles 120 (FIG. 3), as previously described herein. For example, such nozzles or nozzle inserts also may comprise a particle-matrix composite material including a plurality of partially carburized particles 114 and/or fully carburized particles 120 embedded within a cobalt or cobalt-based alloy matrix material 108.

Additional embodiments of the present invention comprise hardfacing materials that include a plurality of partially carburized particles 114 (FIG. 2) and/or fully carburized particles 120 (FIG. 3), as previously described herein. In some embodiments the hardfacing materials may also include macrocrystalline tungsten carbide particles. In other embodiments, the hardfacing materials may be at least substantially free of macrocrystalline tungsten carbide particles. Such hardfacing materials may be applied to the surface of a drill bit or another earth-boring tool to form an erosion and abrasion resistant surface thereon. Techniques for applying hardfacing to earth-boring tools are known in the art and described in, for example, U.S. Pat. No. 4,884,477, which is entitled Rotary Drill Bit with Abrasion and Erosion Resistant Facing and was filed Mar. 31, 1988, U.S. Pat. No. 5,038,640, which is entitled Titanium Carbide Modified Hardfacing for use on Bearing Surfaces of Earth Boring Bits and was filed Feb. 8, 1990, U.S. Pat. No. 5,663,512, which is entitled Hardfacing Composition for Earth-Boring Bits and was filed Nov. 21, 1994, U.S. Pat. No. 6,248,149, which is entitled Hardfacing Composition for Earth-Boring Bits using Macrocrystalline Tungsten Carbide and Spherical Cast Tungsten Carbide and was filed May 11, 1999, and pending U.S. patent application Ser. No. 11/823,800, which is entitled Particle-Matrix Composite Drill Bits With Hardfacing and Methods of Manufacturing and Repairing Such Drill Bits Using Hardfacing Materials and was filed Oct. 31, 2007, the entire disclosure of each of which patent and application is incorporated herein by this reference.

Briefly, a hardfacing material may be formed by heating a metal matrix material 108 to a temperature above its melting point forming a molten metal matrix material 108. Partially carburized particles 114 and/or fully carburized particles 120, as previously described herein, together with the molten metal matrix material 108 may be applied to one or more surfaces of an earth-boring tool to which the hardfacing material is to be applied. The partially carburized particles 114 may be fully formed prior to application of the hardfacing material. The molten particle-matrix material 108 is then allowed to cool and solidify around the partially carburized particles 114 and/or fully carburized particles 120 on the one or more surfaces of the earth-boring tool, thereby forming a hardfacing material comprising a solid particle-matrix composite material 104 on the surface of the earth-boring tool.

While the present invention is described herein in relation to embodiments of concentric earth-boring rotary drill bits that include fixed cutters and to embodiments of methods for forming such drill bits, the present invention also encompasses other types of earth-boring tools such as, for example, core bits, eccentric bits, bicenter bits, reamers, mills, and roller cone bits, as well as methods for forming such tools. Thus, as employed herein, the term "bit body" includes and encompasses bodies of all of the foregoing structures, as well as components and subcomponents of such structures.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. An earth-boring tool for drilling subterranean formations, the earth-boring tool comprising a body comprising a composite material, the composite material comprising a discontinuous phase dispersed throughout a continuous matrix phase, the discontinuous phase comprising:

partially carburized eutectic particles, each partially carburized eutectic particle comprising monotungsten carbide and ditungsten carbide; and fully carburized eutectic particles, each of the fully carburized eutectic particles comprising monotungsten carbide and at least substantially free of ditungsten carbide;

wherein the partially carburized eutectic particles and the fully carburized eutectic particles are at least substantially spherical.

2. The earth-boring tool of claim 1, wherein the partially carburized eutectic particles and the fully carburized eutectic particles have an average sphericity of at least about 0.6.

3. The earth-boring tool of claim 2, wherein the partially carburized eutectic particles and the fully carburized eutectic particles have an average sphericity of at least about 0.9.

4. The earth-boring tool of claim 1, wherein the partially carburized eutectic particles and the fully carburized eutectic particles have an average diameter of less than about 500 microns.

5. The earth-boring tool of claim 4, wherein the partially carburized eutectic particles and the fully carburized eutectic particles have an average diameter within a range extending from about 105 microns to about 250 microns.

6. The earth-boring tool of claim 1, wherein the continuous matrix phase is at least substantially free of metal carbide satellite deposits.

7. An earth-boring rotary drill bit for drilling subterranean formations, the earth-boring rotary drill bit comprising:

a bit body comprising a particle-matrix composite material, the particle-matrix composite material comprising a plurality of at least generally spherical partially carburized eutectic particles dispersed throughout a metal matrix material, each at least generally spherical partially carburized eutectic particle of the plurality comprising both monotungsten carbide and ditungsten carbide; and at least one cutting structure disposed on a face of the bit body.

8. The earth-boring rotary drill bit of claim 7, wherein each partially carburized eutectic particle of the plurality comprises:

an inner core comprising a eutectic composition of monotungsten carbide and ditungsten carbide; and an outer shell of monotungsten carbide surrounding the inner core.

9. The earth-boring rotary drill bit of claim 8, wherein the plurality of partially carburized eutectic particles comprises substantially completely carburized eutectic particles, each of the substantially completely carburized eutectic particles comprising both monotungsten carbide and ditungsten carbide.

10. The earth-boring rotary drill bit of claim 7, wherein the metal matrix material comprises one of a commercially pure metal and a metal alloy.

11. The earth-boring rotary drill bit of claim 10, wherein the metal matrix material comprises a commercially pure metal selected from the group consisting of copper, cobalt, iron, nickel, aluminum, and titanium.

12. The earth-boring rotary drill bit of claim 10, wherein the metal matrix material comprises a metal alloy selected from the group consisting of cobalt-based alloys, iron-based alloys, nickel-based alloys, cobalt- and nickel-based alloys, iron- and nickel-based alloys, iron- and cobalt-based alloys, aluminum-based alloys, copper-based alloys, magnesium-based alloys, and titanium-based alloys.

13. A hardfacing material for use on an earth-boring tool, comprising partially carburized eutectic particles, each of the partially carburized eutectic particles comprising both monotungsten carbide and ditungsten carbide, wherein the partially carburized eutectic particles are cemented within a metal matrix material, wherein the partially carburized eutectic particles are at least substantially spherical.

14. The hardfacing material of claim 13, wherein the hardfacing material is at least substantially free of macrocrystalline tungsten carbide particles.

15. The hardfacing material of claim 13, wherein the hardfacing material is disposed on at least a portion of an exterior surface of a bit body of an earth-boring rotary drill bit.

16. The hardfacing material of claim 13, further comprising at least one of a plurality of sintered tungsten carbide particles and a plurality of macrocrystalline tungsten carbide particles cemented within the metal matrix material.

17. A method for forming an earth-boring rotary drill bit, the method comprising cementing in a metal matrix material a plurality of at least substantially spherical partially carburized eutectic particles, each of the partially carburized eutectic particles comprising both monotungsten carbide and ditungsten carbide.

18. The method of claim 17, wherein cementing in a metal matrix material the plurality of at least substantially spherical partially carburized eutectic particles comprises:

infiltrating the at least substantially spherical partially carburized eutectic particles of the plurality with a molten commercially pure metal or a molten metal alloy; and cooling the molten commercially pure metal or the molten metal alloy to form the metal matrix material in a solid state surrounding the at least substantially spherical partially carburized eutectic particles of the plurality.

19. The method of claim 17, wherein cementing in a metal matrix material the plurality of at least substantially spherical partially carburized eutectic particles comprises:

pressing a powder mixture comprising the plurality of at least substantially spherical partially carburized eutectic particles and a plurality of particles comprising the metal matrix material to form a green body; and sintering the green body to a desired final density.

20. The method of claim 17, further comprising providing the plurality of at least substantially spherical partially carburized eutectic particles prior to cementing in the metal matrix material the plurality of at least substantially spherical partially carburized eutectic particles.

21. The method of claim 20, wherein providing the plurality of at least substantially spherical partially carburized eutectic particles comprises:

exposing a plurality of at least substantially spherical eutectic particles, each comprising both monotungsten carbide and ditungsten carbide, to an alkane gas at a temperature within a range extending from about 2,000° C. to about 2,600° C.; and carburizing at least an outer shell of the plurality of at least substantially spherical eutectic particles.

22. The method of claim 21, wherein exposing a plurality of at least substantially spherical eutectic particles to an alkane gas comprises exposing the plurality of at least substantially spherical eutectic particles to the alkane gas in at least one of a powder bed and a fluidized bed.

23. A method for forming an earth-boring tool, the method comprising:

partially carburizing a plurality of at least generally spherical eutectic particles of tungsten carbide to form a plurality of partially carburized eutectic particles of tungsten carbide having an outer surface at least substantially comprised of monotungsten carbide;

placing the plurality of partially carburized eutectic particles of tungsten carbide within a mold cavity having a shape corresponding to at least a portion of an earth-boring tool;

infiltrating the plurality of partially carburized eutectic particles of tungsten carbide with a molten metal material; and solidifying the molten metal material to form a solid metal matrix material surrounding the partially carburized eutectic particles of tungsten carbide of the plurality.

24. The method of claim 23, wherein partially carburizing the plurality of at least generally spherical eutectic particles of tungsten carbide comprises substantially depleting ditungsten carbide from the plurality of at least generally spherical eutectic particles of tungsten carbide.

25. The method of claim 23, further comprising forming the plurality of at least generally spherical eutectic particles of tungsten carbide.

26. The method of claim 23, wherein partially carburizing the plurality of at least generally spherical eutectic particles of tungsten carbide comprises exposing the plurality of at least generally spherical eutectic particles of tungsten carbide.

27. The method of claim 26, wherein exposing the plurality of at least generally spherical eutectic particles of tungsten carbide to the gas comprising carbon comprises exposing the plurality of at least generally spherical eutectic particles of tungsten carbide to a gas comprising at least one of methane, ethane, and propane at a temperature in a range extending from about 2,000° C. to about 2,600° C.

28. The method of claim 23, wherein partially carburizing the plurality of at least generally spherical eutectic particles of tungsten carbide comprises partially carburizing the plurality of at least generally spherical eutectic particles of tungsten carbide to form a plurality of partially carburized at least generally spherical eutectic particles of tungsten carbide having an inner eutectic core and an outer layer of monotungsten carbide surrounding the inner eutectic core.

29. A method for applying hardfacing material to a surface of an earth-boring tool, the method comprising:

forming a plurality of eutectic particles of tungsten carbide to have an at least substantially spherical shape;

partially carburizing the plurality of eutectic particles of tungsten carbide;

heating a metal matrix material to a temperature above a melting point of the metal matrix material to form molten metal matrix material;

applying the molten metal matrix material and at least some particles of the partially carburized plurality of eutectic particles of tungsten carbide to at least a portion of an exterior surface of an earth-boring tool; and solidifying the molten metal matrix material and cementing the at least some particles of the partially carburized plurality of eutectic particles of tungsten carbide within the solidified metal matrix material.

30. The method of claim 29, wherein partially carburizing the plurality of eutectic particles of tungsten carbide comprises substantially carburizing the plurality of eutectic particles of tungsten carbide.

* * * * *

UNITED STATES PATENT AND TRADEMARK OFFICE

CERTIFICATE OF CORRECTION

PATENT NO. : 8,220,566 B2
APPLICATION NO. : 12/261730
DATED : July 17, 2012
INVENTOR(S) : Jimmy W. Eason, John H. Stevens and James L. Overstreet It is certified that error appears in the above-identified patent and that said Letters Patent is hereby corrected as shown below:

In the claims:

CLAIM 26, COLUMN 14, LINES 21-22, change "carbide." to --carbide to a gas comprising carbon.--

Signed and Sealed this
Twenty-second Day of September, 2015

Michelle K. Lee

Michelle K. Lee
*Director of the United States Patent and Trademark Office*